United States Patent [19]

Hsu et al.

[11] 4,055,462

[45] Oct. 25, 1977

[54] APPARATUS FOR FORMING A FIBER ORIENTED HANDSHEET

[75] Inventors: Thomas C. Hsu; John L. Miller, both of Covington, Va.

[73] Assignee: Westvaco Corporation, New York, N.Y.

[21] Appl. No.: 731,625

[22] Filed: Oct. 12, 1976

[51] Int. Cl.[2] ..... D21F 13/02

[52] U.S. Cl. ..... 162/382; 162/336

[58] Field of Search ..... 162/192, 218, 380, 382, 162/336, 347; 264/87, 108; 73/159; 425/85

[56] References Cited

U.S. PATENT DOCUMENTS

| | | | |
|---|---|---|---|
| 3,117,907 | 1/1964 | Haller | 162/336 |
| 3,947,535 | 3/1976 | Bagg et al. | 264/108 |

OTHER PUBLICATIONS

"Forming Handsheets for Physical Tests of Pulp" Tappi test T205m–47 1947.

*Primary Examiner*—S. Leon Bashore
*Assistant Examiner*—William F. Smith
*Attorney, Agent, or Firm*—W. Allen Marcontell; Richard L. Schmalz

[57] ABSTRACT

The fiber orientation of fourdrinier laid machine made paper is simulated with a bench top handsheet mold by means of a two-axis flow convergent nozzle asymmetrically positioned in the slurry reservoir box of the mold. When a pulp slurry is drained of water, a strong flow stream vector component parallel with the forming wire plane is generated within the flow stream as the slurry flows inductively over the nozzle surfaces and from the nozzle throat.

5 Claims, 3 Drawing Figures

APPARATUS FOR FORMING A FIBER ORIENTED HANDSHEET

BACKGROUND OF THE INVENTION

1. Field of the Invention

The present invention relates to papermaking methods and apparatus. More specifically, the present invention relates to manual or hand methods of molding individual paper sheets with bench top mounted static apparatus.

2. Description of the Prior Art

One of the original processes by which paper has been made included the step of manually screen molding a "handsheet" whereby a dilute aqueous slurry of cellulose fiber was deposited on a sheet sized screen. As the slurry deposit occurred, water drained through the screen pores while the fibers randomly matted on the screen surface. Following the fiber matting, the freshly laid web, still in adherence to the screen, is layered between two absorbent material laminae and pressed. Thereafter, the pressed mat, now a consolidated sheet, may be peeled from the screen and further dried.

There are numerous examples of prior art apparatus for practicing the aforedescribed handsheet making process. However, U.S. Pat. No. 1,995,586 is representative of such prior art as it is relevant to the invention. By productivity comparison to the modern, machine driven screen technique of paper web molding, the individual handsheet molding technique is slow and laborious. Nevertheless, due to the simplicity of necessary tools and equipment, the handsheet technique of papermaking prevails: predominantly in the laboratories of pulp and papermakers for the purpose of pulp evaluation.

The relative strengths and drainage characteristics between two pulp blends may be comparatively measured from handsheets molded from the respective blends. However, heretofore it has been very difficult to directly translate such handsheet measurements to machine laid paper due to the relative difference in fiber orientation. Sheets made from the prior art handsheet technique have a completely random fiber direction orientation. Consequently, the sheet has equal tensile and tear strengths in all directions.

When a paper web is formed on a papermachine, the slurry is deposited on a closed loop screen (fourdrinier). As the screen is driven around the loop, the slurry flows from a slice jet onto the screen codirectionally with the screen travel and highly tangential therewith. The elongated fibers align themselves with the flow stream direction (machine direction; MD) and are deposited on the traveling screen accordingly. Since this fiber oriented aqueous slurry on the traveling screen is quickly consolidated to a mat, little opportunity is allowed for the flow aligned fibers to gain a random disposition. Consequently, the tensile strength of machine laid paper is considerably greater along the MD than along the CD (cross direction; transverse of flow stream direction).

Since the advent of the fourdrinier paper machine, there has been a need for a laboratory scale technique and/or apparatus to simulate, in a handsheet, the fiber orientation distribution of a fourdrinier pulp deposition. To the degree that this need has been satisfied, it has been with scale model fourdrinier machines. However, such a model for producing a mere 6 inch wide web is still, in absolutes a large, complicated and costly apparatus.

It is, therefore, an object of the present disclosure to teach a method and apparatus for molding paper handsheets having a directionally oriented fiber distribution.

Another object of the present invention is to simulate the fiber distribution pattern of a fourdrinier machine, with mechanically static, bench-top equipment.

SUMMARY OF THE INVENTION

These and other objects of the invention are accomplished by means of a two-axis asymmetrical convergent nozzle restricted flow conduit onto the forming wire of a bench mounted, vacuum drained handsheet mold. The nozzle throat is aligned with greater proximity to one of the two axially parallel handsheet edges than to the other thereby inducing a flow vector component in the slurry charge that is unidirectionally parallel with the plane of the forming wire as the slurry flows from the nozzle throat onto the wire under the differential driving pressure.

BRIEF DESCRIPTION OF THE DRAWING

Relative to the drawing wherein like reference characters designate similar structural elements throughout the several figures of the drawing.

DESCRIPTION OF THE PREFERRED EMBODIMENTS

Figure 1:
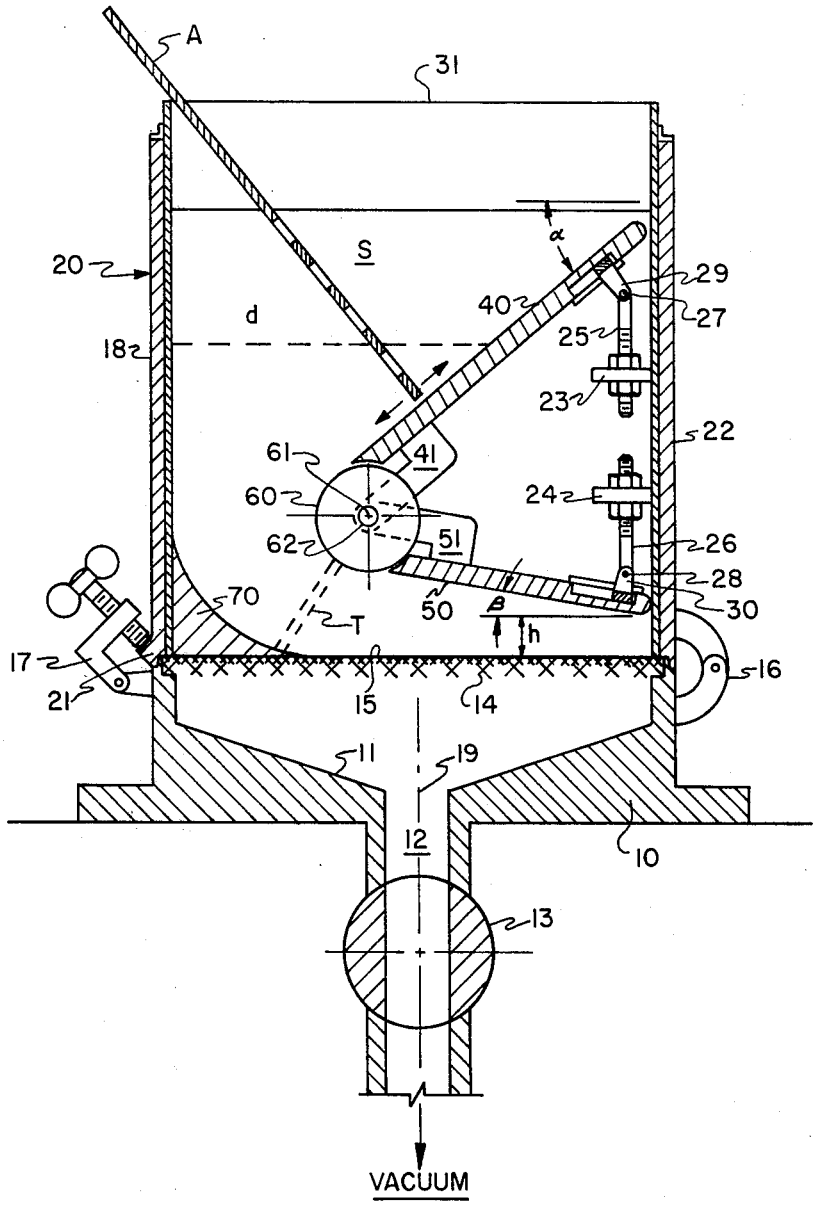
FIG. 1 is an orthographic section of the present invention apparatus.

Relative to the drawing there is shown a bench top, square sheet mold apparatus comprising a sink base 10 having a slopped bottom sink 11 converging an evacuated drain conduit 12 controlled by a ball valve 13.

Across the top opening of the sink 11 is provided a heavy gauge, relatively course mesh (eight strands per inch) screen 14 for structural support of a finer mesh (22 strands per inch) forming wire 15.

Pivotally secured to the base 10 by means of hinges 16 is an essentially rectangular section reservior box 20. Along a base edge opposite from the hinge 16 edge, wing-nut clamps 17 are pivotally secured to the base 10 and tighten against box shoulder 21.

Normally, the lateral alignment of the reservoir box 20, the forming wire 15 and the sink 11 is symmetric about the drain axis 19.

Structure described thus far constitutes handsheet mold apparatus well known to the prior art. Although such structure, per se, is not to be claimed as our invention, said described structure does, in combination with structure hereafter described, constitute an operational element of our invention.

As the invention apparatus is described relative to FIG. 1, it is to be noted that the structure is dimensionally consistent about the orthographic projection axis perpendicular to the illustration sheet. Consequently, two-axis flow analysis assumptions apply.

On wall 22 of the reservoir box 20, selected arbitrarily as the back wall, is provided with hanger brackets 23 and 24 for adjustably securing threaded rod hangers 25 and 26. The distal ends of the rod hangers opposite from brackets 23 and 24 support pivotal journal pins 27 and 28 which are seated in journal brackets 29 and 30. The journal brackets are adjustably secured to upper and lower flow guide surfaces 40 and 50, respectively, so that the dimension *h* and angles $\alpha$ and $\beta$ may be selectively changed as threaded rods 25 and 26 move parallel to the drain axis 19.

The distal edges of the flow guide plane surfaces 40 and 50 opposite from the back wall 22 are pivotally secured at the axis 61 of a cylindrical nose surface 60 by means of journal brackets 41 and 51 which receive an axle pin 62. The journal brackets 41 and 51 are offset from the upper and lower guide surface structure to permit tangential fairing of the plane surfaces with the cylindrical surface of the nose structure 60. The axle pin 62 may be provided with shoulders and clamping threads to secure the journal joint with brackets 41 and 51 from rotation at the desired position.

The bottom horizontal corner of reservoir box 20 between the front wall 18 and the forming wire 15 is faired with a concave fillet 70 to form an outer flow guide surface.

Considering the several flow guide surfaces 40, 50, 60 and 70, collectively, an asymmetric two-axis convergent area nozzle, relative to the drain axis 19, is formed thereby with the line of throat discharge having a strong vector component parallel to the forming wire 15 plane. Stated differently, the plane of the nozzle discharge throat T is positioned with a substantial angle of departure from the plane of the forming wire 15. An acute angle of less than 45° between the throat plane T and the drain axis 19 is preferred.

For maximum utilization of prior art equipment, the flow guide surfaces and support structure may be structurally unitized within an open ended, substantially rectangular, thin, liner element 31 which slideably sleeves the internal wall surfaces of reservoir box 20. By means of the liner 31 fabrication technique, the original capabilities of an existing handsheet mold may be retained by simply removing the liner 31 from the box 20.

Operation of the present invention is not generally different from prior art handsheet molding techniques. There are, however, some significant distinctions due to the uniformly convergent flow guide surfaces within the reservoir 20. Starting with an empty reservoir 20 and a closed position for valve 13, the sink 11 and a portion of the reservoir 20, up to a demarcation line *d* approximately midway along the length of upper guide surface 40, is filled with clear water. Into the reservoir volume above line *d* is poured a concentrated fiber slurry *s* of appropriate consistency. Perforated plate agitator A is then inserted as shown and oscillated about the upper lip edge of front wall 18 to homogeneously mix the fiber constituency of concentrated slurry *s* with the clear water bottom charge above the forming wire 15. Although reciprocatory agitation motion is preferred, it is to be noted that such reciprocatory motion prevails with the described technique due to the small angle of oscillation permitted about the front wall 18 lip. Following agitation, the agitator A is withdrawn from the slurry which is left undisturbed for a time period sufficient to permit hydrostatic stabilization. This time period is in the order of 5 seconds from the moment of agitator A removal and is signified by a continuous reflective surface of the slurry charge. At this moment, the valve 13 is opened to connect the sink 11 and reservoir 20 volume to an evacuated receiving vessel not shown. Quiescent time periods in excess of minimums indicated are to be avoided due to undesirable settling of the suspended fibers.

Figure 2:
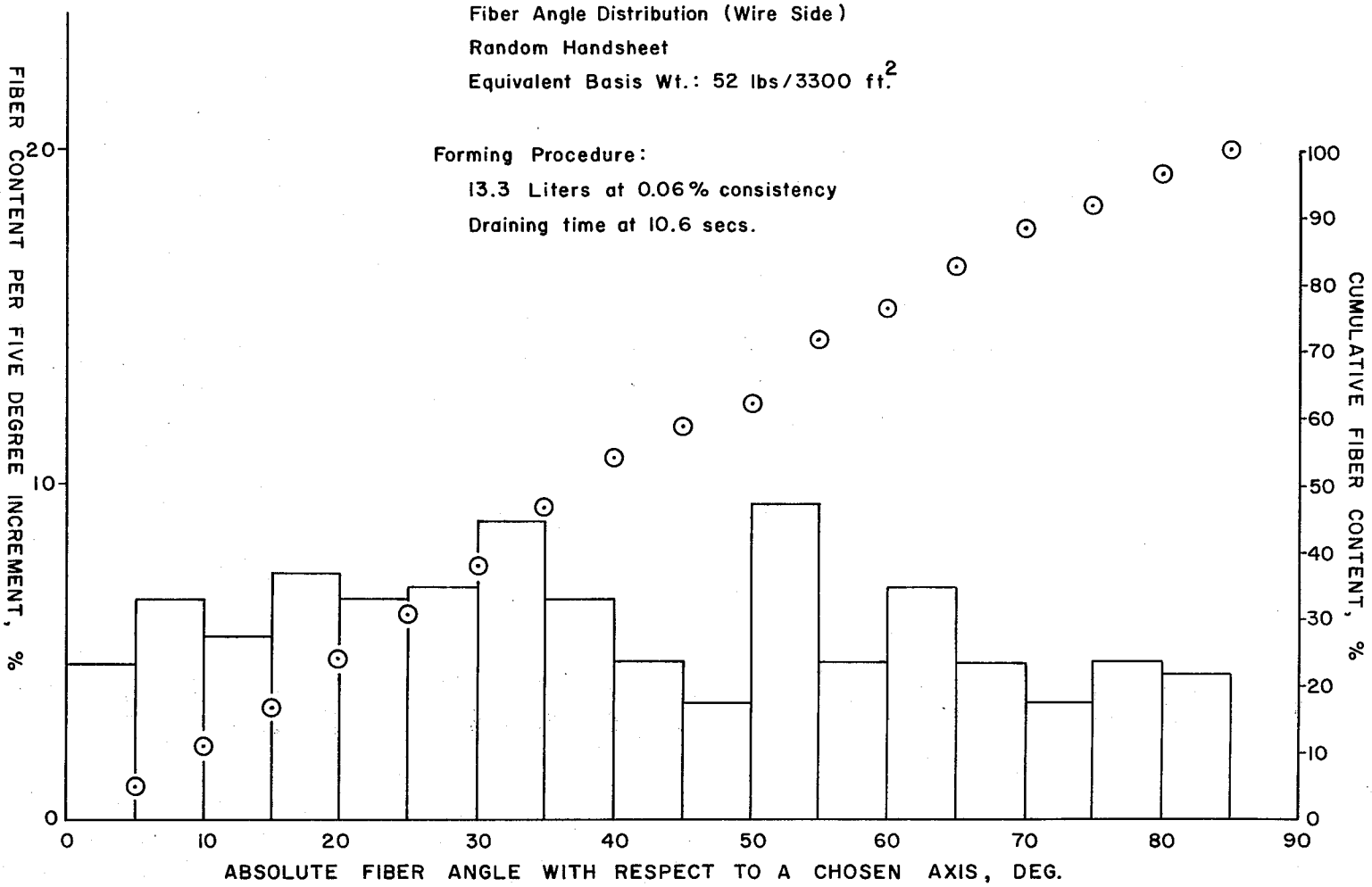
FIG. 2 is a graphic plot of fiber orientation in a handsheet laid on prior art equipment; and, FIG. 3 is a graphic plot of fiber orientation in a handsheet laid by the present method and apparatus.
Figure 3:
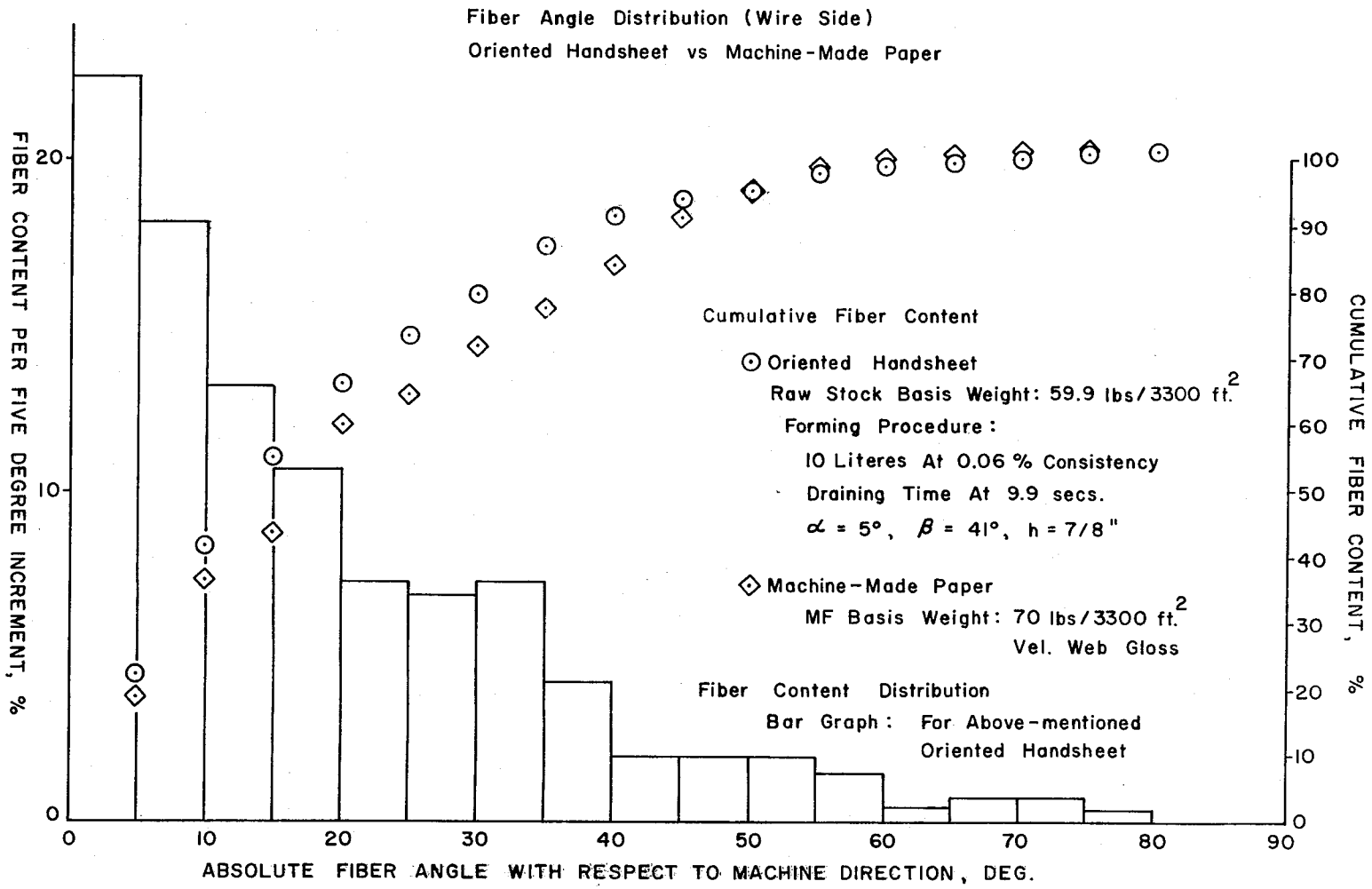

Performance of the present invention is represented by comparing the graphs of FIGS. 2 and 3. FIG. 2 illustrates the fiber distribution characteristics of a paper handsheet molded on a prior art device of the type described herein. The reference axis from which fiber angle measurements were taken was aribitrarily selected. The increments of measurement were taken to both sides of the axis so that the absolute angles indicated are in plus and minus quadrants, inclusive. The bar graph shows a mild scattering of the fiber content relative to angular orientation but the point graph of cumulative fiber content very closely approximates a straight line as it would be if the fiber distribution laid in a true random pattern. The ordinate of each cumulative point equals the sum of bar graph increment ordinates preceding. It will be noted from the FIG. 2 legend data that the average drainage rate was 1.25 liters/sec.

FIG. 3 illustrates the data of parameters identical to those of FIG. 2 taken from handsheets formed by the present invention. In addition, data taken from paper samples laid on a full-scale production fourdrinier machine is superimposed to graphically illustrate the capacity of the invention to simulate a machine-laid fiber distribution pattern.

FIG. 3 legend data describes an average pulp drainage rate for the oriented fiber handsheet as 1.01 liters/-sec.

Identical pulp was used to obtain the data of both FIGS. 2 and 3.

Since the invention apparatus used to obtain the FIG. 3 data was of the embodiment described for adaptation to existing handsheet mold equipment, it should be noted that the drainage area for the oriented fiber handsheet was 29% less than the drainage area for the random fiber handsheet.

Experience with the present invention has shown that the degree of fiber orientation in a handsheet may be selectively varied by coordinating the two nozzle surface angles $\alpha$ and $\beta$ with the pulp drainage rate. The angle $\beta$ setting is the most important apparatus variable affecting good sheet formation. The angle $\alpha$ must be large enough to prevent an accumulation of pulp fiber on the upper flow guide surface 40. Apparatus variable *h* is adjusted relative to the desired sheet basis weight which affects the thickness of fiber mat formed upon the wire 15.

Having fully described our invention, we claim:

1. An apparatus for forming a paper handsheet having a substantially unidirectional fiber orientation from a dilute slurry of paper pulp comprising a pulp reservoir vessel constructed substantially symmetrical about a vertical drain axis, a sink vessel disposed beneath said pulp vessel, a horizontal forming wire separating said pulp vessel from said sink vessel, a valved conduit drain from said sink, the improvement comprising:

substantially rectangular thin liner means of substantially uniform section transverse of said drain axis inserted within said pulp vessel, and first and second flow guide surfaces within said liner means forming a two-dimensional convergent nozzle therein having a planar throat area positioned in the proximity of said forming wire and asymmetrical of said drain axis, the plane of said throat disposed at an acute angle relative to said drain axis.

2. An apparatus as described by claim 1 wherein said first flow surface being an outer flow surface comprising a concave fillet surface fairing the respective liner side with said forming wire.

3. An apparatus as described by claim 2 wherein said second flow surface being an inner flow surface comprising upper and lower plane surfaces, each having one edge faired tangentially to a cylindrical nose surface.

4. An apparatus as described by claim 3 wherein said one edge of said plane surfaces is secured for selective pivoting about an axis of said nose surface.

5. An apparatus as described by claim 4 wherein the end of said plane surfaces opposite of said one edge pivotally secured to the respective liner side by pivot means, said pivot means being selectively positionable parallel with said drain axis.

* * * * *

UNITED STATES PATENT OFFICE

CERTIFICATE OF CORRECTION

PATENT NO. : 4,055,462

DATED : October 25, 1977

INVENTOR(S) : Thomas C. Hsu and John L. Miller

It is certified that error appears in the above-identified patent and that said Letters Patent are hereby corrected as shown below:

Column 2, line 63, "On" should be --One--. Column 6, line 4 (Claim 5, line 2), following "edge" should be --is--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*